United States Patent [19]

Hale

[11] Patent Number: 4,911,668

[45] Date of Patent: Mar. 27, 1990

[54] METHOD OF ATTACHING COMA CORRECTION MEMBERS TO AN INLINE ELECTRON GUN

[75] Inventor: John R. Hale, Lancaster, Pa.

[73] Assignee: RCA Licensing Corporation, Princeton, N.J.

[21] Appl. No.: 255,239

[22] Filed: Oct. 11, 1988

[51] Int. Cl.[4] ..... H01J 9/18; H01J 9/46

[52] U.S. Cl. ..... 445/36; 228/159

[58] Field of Search ..... 313/431, 414, 437, 413; 228/159; 445/36

[56] References Cited

U.S. PATENT DOCUMENTS

| | | | |
|---|---|---|---|
| 4,556,819 | 12/1985 | Chen et al. | 313/413 |
| 4,593,226 | 6/1986 | Naiki | 313/413 |
| 4,633,130 | 12/1986 | McCandless | 228/159 |
| 4,754,189 | 6/1988 | Sluyterman | 313/414 |

*Primary Examiner*—Kenneth J. Ramsey

*Attorney, Agent, or Firm*—Joseph S. Tripoli; Dennis H. Irlbeck

[57] ABSTRACT

The present invention provides an improvement in a color picture tube having an inline electron gun with coma correction members therein. The gun includes at least two electrodes that form a main focusing lens and a shield cup interconnected to one of the main focus electrodes. The improvement comprises the coma correction members being attached to the outside surface of the shield cup facing the main focusing lens electrodes. In a method of attaching the coma correction members to the shield cup, the members are provided as one of a plurality of sets of members in a continuous strip. One set of members are placed against the outside surface of the bottom of the cup and welded thereto. Portions of the strip that are not part of the welded members are broken-away from the welded members.

1 Claim, 3 Drawing Sheets

METHOD OF ATTACHING COMA CORRECTION MEMBERS TO AN INLINE ELECTRON GUN

BACKGROUND OF THE INVENTION

The present invention relates to a color picture tube having an improved inline electron gun with coma correction members, and particularly to an improvement in the gun that facilitates its fabrication.

An inline electron gun is one designed to generate or initiate preferably three electron beams in a common plane and direct those beams along convergent paths to a point or small area of convergence at the tube screen.

A problem that exists in a color picture tube having an inline gun is coma distortion, wherein the sizes of the electron beam rasters scanned on the screen by an external magnetic deflection yoke are different because of the eccentricity of the two outer beams with respect to the center of the yoke.

There are many patents that disclose various coma correction members located at the exits of the electron guns. These members affect fringe portions of the magnetic deflection fields to either enhance or shunt the fields at the electron beam paths. One such patent is U.S. Pat. No. 4,556,819, issued on Dec. 3, 1985 to Chen et al., wherein four coma correction members are attached to the inside bottom of a shield cup. The positioning of the members relative to each other and relative to the electron beams is very important for achieving proper coma correction. However, it is sometimes difficult to accurately position the members on the bottom of the shield cup because of interference from the shield cup sidewalls.

SUMMARY OF THE INVENTION

The present invention provides an improvement in a color picture tube having an inline electron gun with coma correction members. The gun includes at least two electrodes that form a main focusing lens and a shield cup mechanically interconnected to one of the main focus electrodes. The improvement comprises the coma correction members being attached to the outside surface of the shield cup facing the main focusing lens electrodes.

DETAILED DESCRIPTION OF THE PREFERRED EMBODIMENT

Figure 1:
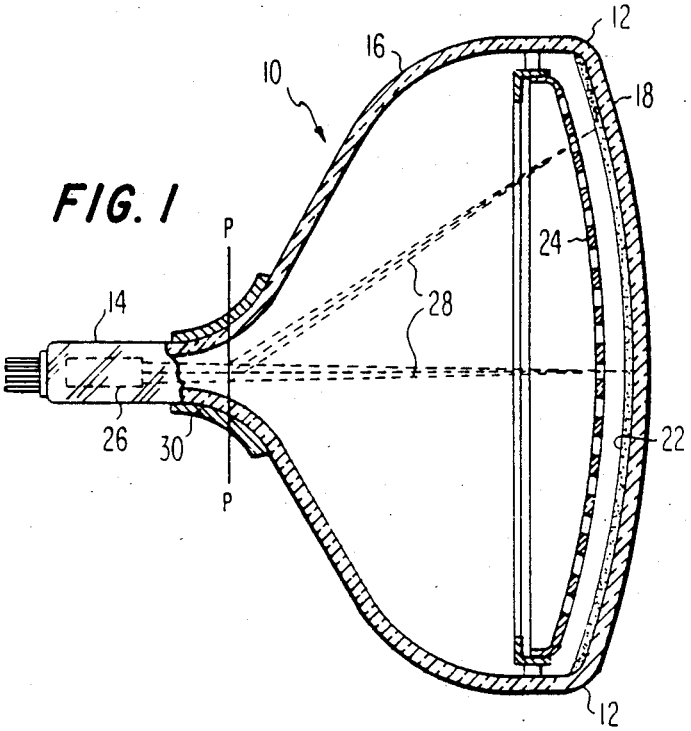
FIG. 1 is a plan view, partly in axial section, of a shadow mask color picture tube embodying the invention.

FIG. 1 is a plan view of a rectangular color picture tube 10 having a glass envelope comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A three-color phosphor screen 22 is carried by the inner surface of the faceplate 18. The screen 22 is preferably a line screen with the phosphor lines extending substantially perpendicular to the high frequency raster line scan of the tube (i.e., normal to the plane of FIG. 1). A multi-apertured color-selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along initially coplanar convergent paths through the mask 24 to the screen 22.

The tube of FIG. 1 is designed to be used with an external magnetic deflection yoke, such as the self-converging yoke 30 shown surrounding the neck 14 and funnel 12 in the neighborhood of their junction. When activated, the yoke 30 subjects the three beams 28 to both vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of the electron gun 26. For simplicity, the actual curvature of the deflected beam paths in the deflection zone is not shown in FIG. 1.

Figure 2:
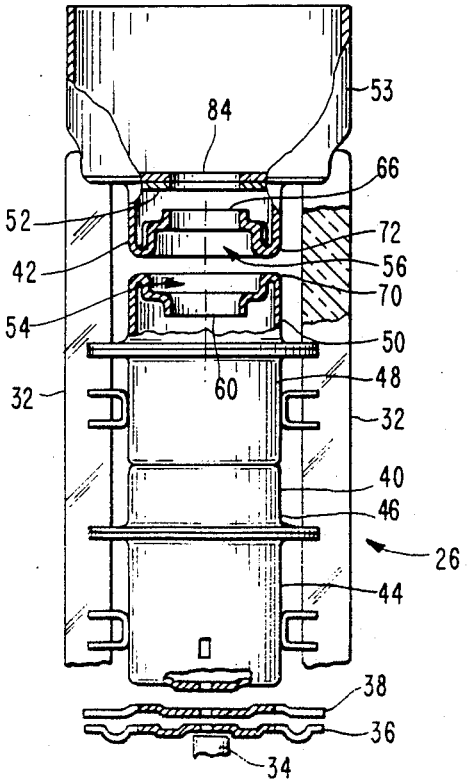
FIG. 2 is a partial axial section view of the electron gun shown in dashed lines in FIG. 1.
Figure 3:
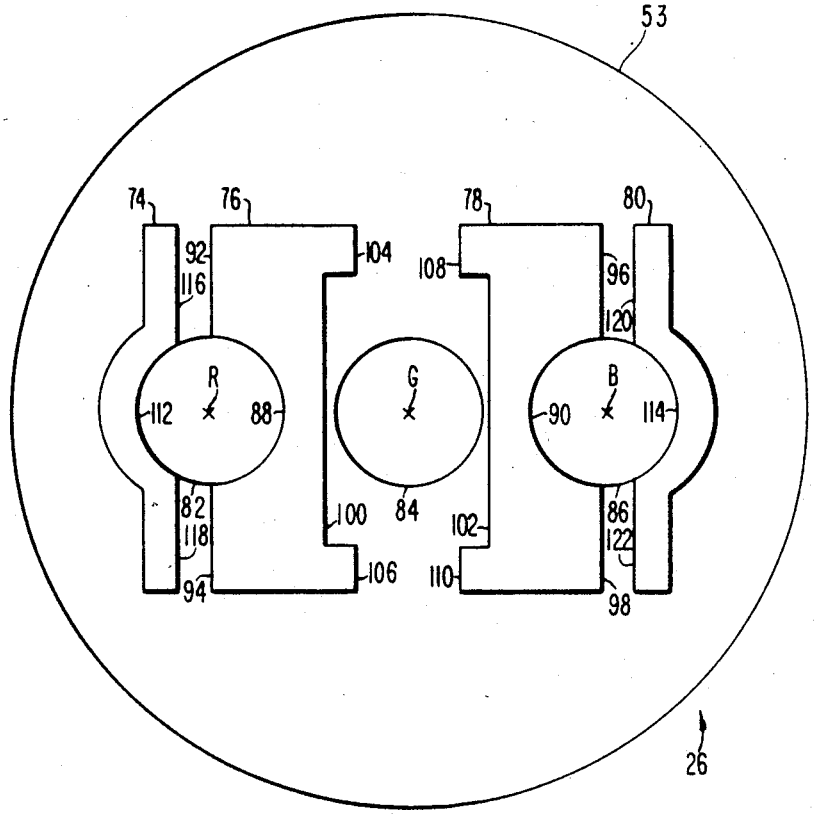
FIG. 3 is a plan view of the outside bottom of the shield cup of the gun shown in FIG. 2.

The details of the electron gun 26 are shown in FIGS. 2 and 3. The gun 26 comprises two glass support rods 32 to which the various electrodes are attached or mounted. These electrodes include three equally spaced coplanar cathodes 34 (one for each beam), a control grid electrode 36 (G1), a screen grid electrode 38 (G2), a first accelerating and focusing electrode 40 (G3), and a second accelerating and focusing electrode 42 (G4), spaced along the glass rods 32 in the order named. Each of the G1 through G4 electrodes has three inline apertures therein to permit passage of three coplanar electron beams. The main electrostatic focusing lens in the gun 26 is formed between the G3 electrode 40 and the G4 electrode 42. The G3 electrode 40 is formed with four cup-shaped elements 44, 46, 48 and 50. The open ends of two of these elements, 44 and 46, are attached to each other, and the open ends of the other two elements, 48 and 50, are also attached to each other. The closed end of the third element 48 is attached to the closed end of the second element 46. Although the G3 electrode 40 is shown as a four-piece structure, it could be fabricated from any number of elements, including a single element of the same length. The G4 electrode 42 also is cup-shaped, but has its open end closed with an apertured plate 52. A shield cup 53 is attached to the plate 52 at the exit of the gun 26.

The facing closed ends of the G3 electrode 40 and the G4 electrode 42 have large recesses 54 and 56, respectively, therein. The recesses 54 and 56 set back the portion of the closed end of the G3 electrode 40 that contains three apertures 60 from the portion of the closed end of the G4 electrode 42 that contains three apertures 66. The remaining portions of these closed ends of the G3 electrode 40 and the G4 electrode 42 form rims 70 and 72, respectively, that extend peripherally around the recesses 54 and 56. The rims 70 and 72 are the closest portions of the two electrodes 40 and 42.

Located on the outside surface of the bottom of the shield cup 53 are four magnetically permeable coma correction members 74, 76, 78 and 80. The bottom of the shield cup 53 includes three apertures, 82, 84 and 86, through which the electron beams pass. The centers of the undeflected electron beam paths are designated R, G and B. The R and B paths are the outer beam paths, and the G path is the center beam path. The member 76 is located between the center beam path G and the outer beam path R, and the member 78 is located between the center beam path G and the side beam path B. The member 74 is located outside the outer beam path R, and the member 80 is located outside the outer beam path B.

The outward sides of the members 76 and 78 that face the outer beam paths R and B, respectively, include inwardly curved arcuate portions, 88 and 90, which conform to the apertures 82 and 86, respectively, to partially surround the outer beam paths. The remaining portions, 92 and 94, and 96 and 98, of the outward sides of the members 76 and 78, respectively, extend outward toward the members 74 and 80, respectively. The inward sides of the members 76 and 78 that face the center beam path G include straight central portions 100 and 102, respectively, and inwardly extending legs, 104 and 106, and 108 and 110, at the opposite ends thereof, respectively.

The inward sides of the members 74 and 80 that face the outer beam paths R and B include outwardly curved arcuate portions, 112 and 114, which conform to the apertures 82 and 86, respectively, to partially surround the outer beam paths. The remaining portions 116 and 118, and 120 and 122, of the inward sides of the members 74 and 80, respectively, extend inward toward the members 76 and 78, respectively.

The four coma correction members 74, 76, 78 and 80 are located in a fringe portion of the deflection zone of the color picture tube 10. In operation, the yoke 30 establishes two orthogonal magnetic deflection fields in the deflection zone of the tube. These fields are generally known as the vertical and horizontal deflection fields, even though the faceplate of the tube may be oriented other than vertically. The vertical deflection field has lines of flux that extend horizontally and cause deflection of the electron beams perpendicularly to those lines of flux. In the electron gun 26, the vertical deflection is perpendicular to the inline direction of the inline electron beams, and the lines of flux that cause vertical deflection are substantially parallel to the inline direction of the inline electron beams. The horizontal deflection field has lines of flux that extend vertically and cause deflection of the electron beams perpendicularly to those lines of flux. In the electron gun 26, the horizontal deflection is parallel to the inline direction of the inline electron beams, and the lines of flux that cause horizontal deflection are substantially perpendicular to the inline direction of the inline electron beams.

Figure 4:
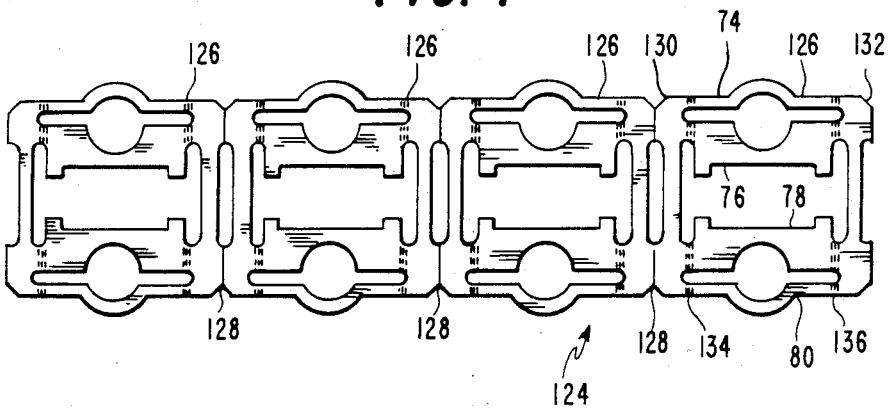
FIG. 4 is a plan view of a strip of coma correction members.

FIG. 4 shows a strip 124 of coma correction members 74, 76, 78 and 80. The strip 124 includes a plurality of sections 126 that can be easily separated by flexing the strip at breakaway lines 128. Each section 126 includes a set of four coma correction members 74, 76, 78 and 80. The members are interconnected to each other at their ends by two tabs 130 and 132. After the members are welded to a shield cup, the tabs 130 and 132 are broken-away from the members at breakaway lines 134 and 136, respectively.

Figure 5:
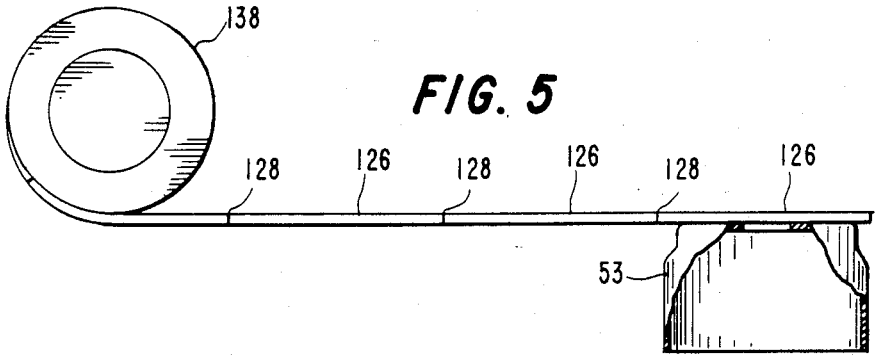
FIG. 5 is a side view of a coiled strip of coma correction members and a shield cup, showing a set of the members being attached to the cup.

FIG. 5 shows how the strip 124 is used to attach the coma correction members 74, 76, 78 and 80 to the shield cup 53. The strip 124 is pulled from a reel 138 to place a section 126 including the four members on the outer surface of the bottom of the shield cup 53. The members are then welded to the shield cup. Thereafter, the section 126 with the welded members is separated from its adjacent section by flexing the strip at the breakaway line 128. Next, the tabs 130 and 132 are removed by flexing them about the breakaway lines 134 and 136.

Use of the above-described method provides an easier and more accurate method of attaching coma correction members to electron gun shield cups. Because of the ease of handling and accuracy provided by this method, the resultant electron guns have greater uniformity within gun types and, therefore, provide more accurate coma correction.

What is claimed is:

1. A method of attaching coma correction members to a shield cup of an electron gun, comprising providing said coma correction members as one of a plurality of sets of coma correction members included in a continuous strip, placing said one set of coma correction members included in said strip against the outside surface of the bottom of said shield cup, welding the coma correction members of said one set to said shield cup, and breaking-away portions of said strip that are not part of said welded coma correction members from said welded coma correction members.

* * * * *